US009416503B1

(12) United States Patent
Sargent

(10) Patent No.: US 9,416,503 B1
(45) Date of Patent: Aug. 16, 2016

(54) ROAD SURFACE SEAM SEALING AND DRYING APPARATUS

(76) Inventor: Isaac Sargent, Hermon, ME (US)

( * ) Notice: Subject to any disclaimer, the term of this patent is extended or adjusted under 35 U.S.C. 154(b) by 0 days.

(21) Appl. No.: 13/227,601

(22) Filed: Sep. 8, 2011

Related U.S. Application Data

(63) Continuation-in-part of application No. 12/178,927, filed on Jul. 24, 2008, now abandoned.

(51) Int. Cl.
*E01C 23/14* (2006.01)

(52) U.S. Cl.
CPC ..... *E01C 23/14* (2013.01)

(58) Field of Classification Search
CPC ..... E01C 23/14
USPC ..... 404/84.05, 93, 94, 95
See application file for complete search history.

(56) References Cited

U.S. PATENT DOCUMENTS

| | | | | |
|---|---|---|---|---|
| 4,376,007 | A * | 3/1983 | Eigenmann | 156/497 |
| 4,711,600 | A * | 12/1987 | Yates | 404/95 |
| 5,092,706 | A * | 3/1992 | Bowen et al. | 404/77 |
| 5,131,788 | A * | 7/1992 | Hulicsko | 404/108 |
| 5,599,133 | A * | 2/1997 | Costello | E01C 23/14 404/72 |
| 6,371,689 | B1 * | 4/2002 | Wiley | 404/77 |
| 6,939,079 | B2 * | 9/2005 | Lloyd | E01C 23/065 404/90 |
| 6,988,849 | B1 * | 1/2006 | Zimmerman | 404/95 |
| 7,252,455 | B2 * | 8/2007 | Larsen | E01C 23/14 404/75 |
| 7,448,825 | B2 * | 11/2008 | Kasahara et al. | 404/80 |
| 7,607,860 | B2 * | 10/2009 | Novak | 404/77 |

FOREIGN PATENT DOCUMENTS

WO 94/26982 * 11/1994

* cited by examiner

*Primary Examiner* — Gary Hartmann
(74) *Attorney, Agent, or Firm* — Anthony D. Pellegrini

(57) ABSTRACT

Drying apparatus for drying a road surface prior to laying down asphalt includes an air jet for pushing liquid away from a road surface, and a heater for drying the road surface. The air jet removes standing water from the road surface and the dryer evaporates any residual moisture on the surface.

32 Claims, 11 Drawing Sheets

ROAD SURFACE SEAM SEALING AND DRYING APPARATUS

This application is a continuation-in-part of U.S. application Ser. No. 12/178,927, filed on Jul. 24, 2008, which is incorporated herein in its entirety.

BACKGROUND INFORMATION

1. Field of the Invention

The invention relates to road paving equipment. More particularly, the invention relates to a method of drying roadway prior to laying asphalt and equipment for practicing the same method.

2. Description of the Prior Art

Applying asphalt pavement to roads frequently requires that the asphalt be applied in sections, because the road is too wide to process in a single pass. Thus, first one section of the road width is paved and then the second section. For reasons of simplicity, width sections will be referred to hereinafter as "lanes," although it is understood that the actual width of the paving step does not have to correspond to a driving lane on the road. The area where one lane of asphalt overlaps another will be referred to as the "seam area."

Typically, a first lane will be paved along a long stretch of road and the second lane paved at a later time, such as the next day or several days or even weeks later. No matter what the time difference is between paving the first lane and the second lane, the asphalt laid down on the first lane will already have cooled to what shall be referred to as "road temperature" by the time fresh hot asphalt is applied to the second lane. "Road temperature" is the temperature of the road surface, and "road surface" may include a portion of the first lane and second lane.

Asphalt is laid down warm, typically around 250 degrees F., so that it bonds with the substrate. Asphalt as it is being applied to the road surface shall be referred to hereinafter as "fresh hot asphalt," to distinguish it from asphalt that has previously been laid down and has cooled to road temperature. After the first lane has been paved, fresh hot asphalt is applied to the second lane such that it overlaps a few inches with the asphalt of the first lane in the seam area. Ideally, the fresh hot asphalt overlapping the seam area should bond sufficiently with the asphalt of the first lane, to form a water-impervious seam. A common and well known problem, however, is that, when fresh hot asphalt is laid down on top of asphalt that is at road temperature, the difference in temperature prevents a good bond from forming. As a result, cracks form along the seam. Water then seeps through the cracks under the asphalt and down toward the sides of the roadway. Eventually, cracks form in the surface, which results further progressive deterioration of the asphalt surface.

Efforts have been made to correct this fault. Some systems have used gas torch heaters arranged so that they move ahead of the paving machinery and heat the bonding edge of the previously laid-down asphalt. One problem with gas heaters is that it is often difficult to control the heater to prevent too much heat from being applied and from being applied too directly. As a result, overheating is a common problem and, if overheated to the flash point, the asphalt can burst into flame.

An additional problem with laying asphalt is that the road surface must be very dry. If moisture has accumulated on the road surface, either from rain, dew, or melting snow or ice, or from some other event, the asphalting operation is held up until the road has dried. Most methods of drying a road surface entail blasting massive quantities of heated air onto the surface at a high velocity. Most systems using this method have no control over the temperature of the surface that is being heated, with the result that excessive heat can burn the surface and/or burn the asphalt. Such systems typically include jet engines, such as are used on racetracks, and burn at temperatures well above 1400 degrees Fahrenheit. In order to prevent damage to the surface, the engine has to be continually moving across the surface, so as not to overheat the surface. Efforts to solve this problem include limiting the air temperature to 300 degrees Fahrenheit, but that severely limits the drying capability and makes it very time-consuming to evaporate standing water from the road.

Drying a road surface with heated air is generally inefficient, especially when the jet engine is required to move at a relatively high velocity across the surface. The jet engines used to dry racetracks, for example, burn 150-200 gallons of fuel per hour. The heated air is on the surface for only a short period of time, before it moves into the surrounding air and is then wasted, with regard to heating the surface.

Typically, the efficiency of a fuel-burning heater, i.e., a burner, is limited to close to its rated capability. The ability to reduce burner output is very limited. For example, the output may be reduced to 70% of the rated capacity in some fuel-burning heaters, but any further reduction may extinguish the burner. In order to reduce the output to less than the 70%, for example, the burner may have to cycle on and off, which is an inefficient way to operate a burner. Furthermore, when the burner output is reduced, heat may be uneven, resulting in hot and cold spots.

Fuel-burning heaters are also very susceptible to wind. When using a propane heater, for example, heat is produced by burning gas being forced over a volume of air at low pressure. If there is airflow in a direction opposite the direction of flow of the burning gas, the gas will either not flow out or not burn. This results in spotty heating, with hot and cold spots.

Other efforts to dry a road surface include vacuuming the water from the surface. US Patent Application 2010/0024242 A1 discloses mobile surface drying apparatus that uses a combination blower/vacuum assembly to dry the road surface. One of the disadvantages of the apparatus is that, when using a vacuum head to suction water off the road surface, the vacuum head must be placed very close to the road surface. Road surfaces are typically uneven, which means that the vacuum head has to be placed high enough above the surface to ensure clearance of the highest points, and that leads to inconsistent results. Some areas are free of water, others not, because the vacuum head is positioned too far away from low points in the surface.

What is needed, therefore, is a method of and system for drying a road surface. What is further needed is such a method that is energy efficient and effective in removing moisture from the surface and from the surrounding air.

BRIEF SUMMARY OF THE INVENTION

The invention is a seam sealer for asphalt paving and a method of sealing an asphalt-paving seam. The seam sealer comprises a an electric heater for pre-heating the road surface to be paved, plus a power supply unit for supplying energy to the heater, and a control system with a heat sensor. The heater may be one or more electric heaters. Certain advantages are provided by using multiple heaters and the description hereinafter will be based on the use of multiple heaters, although it is understood that it may be desirable to use a single heater in certain applications. The heaters are mounted in a moving vehicle and are arranged such that they sequentially travel above the road surface in the seam area and apply heat to the road surface. The seam area is a narrow strip of road surface that spans a few inches of the adjacent edges of the first and second lanes, i.e., a few inches the lane previously asphalted and a few inches of the lane still to be asphalted. The purpose of the heaters is to heat the road surface in the seam area to a desired temperature that is close to that of the fresh hot asphalt that will be applied. The sensor monitors the temperature of the road surface and adjusts the heater output to maintain the desired temperature on the road surface. The desired temperature may be selected to be some degrees above the temperature of the fresh hot asphalt that is to be applied, so that temperatures of the fresh hot asphalt and the previously laid down asphalt on the road surface are close enough to allow the fresh hot asphalt and the previously laid down asphalt to form a molten mass that fuses together seamlessly when the road roller rolls over it and presses it together.

The heaters are extendable out from the vehicle, so that they are positioned above the seam area. The heaters may be positioned at varying distances above the seam area. For example, a first heater may be positioned 8 inches above the pavement, a second heater 12 inches, and so on. In this way, the series of heaters applies a graduated heat to the seam area, initially pre-heating it with a high degree of heat to obtain the desired temperature, and then applying decreasing amounts of heat with each subsequent heater. The first heater may be on all the time, but, as heat builds up on the surface, it takes less and less heat to maintain the desired temperature. Thus, subsequent heaters may shut off, if the temperature is at the desired level. In this way, the road surface in the seam area is heated to the desired temperature in a very controlled manner, thereby eliminating the risk that the previously laid down asphalt in the first lane will combust or chemically break down. The graduated application of heat may be achieved in any of several ways: by setting the heaters to progressively higher distances from the road surface, by using heaters of various output capacities, or by using temperature sensors to control the on/off cycling of the heaters.

The seam sealer may be moved alongside the seam area a pre-determined distance in front of the paving equipment that is applying the fresh hot asphalt, so that an estimated amount of time lapses before the fresh hot asphalt is applied to the second lane. This allows the pre-heated asphalt of the first lane to "cure" or normalize, before the fresh hot asphalt is applied. This curing process allows the heat from the seam sealer to penetrate a certain distance down into the previously laid asphalt of the first lane, so that the asphalt is well heated and not just heated superficially. This heat penetration prior to applying the fresh hot asphalt ensures a better bond, because material from both the previously laid down asphalt and the fresh hot asphalt forms a molten mass and, when pressed together, forms a water-tight, smooth, and seamless bond.

It is particularly advantageous, however, if the seam sealer according to the invention can move along the pavement directly behind the paving equipment, while the freshly laid asphalt is still warm and soft, to seal the seams. Because the asphalt is still warm, using a conventional vehicle would leave undesirable track depressions in the pavement. For this reason, a truck having rollers instead of wheels is used to carry the seam sealing equipment.

A further invention to improve the asphalting process is a method of drying a road surface and apparatus for implementing the method. A road surface must be completely dry before asphalt can be laid down. It rains frequently in many geographic areas, for example, in New England, so that often a road is too wet to lay down the asphalt. It is often desirable to mechanically dry the surface, so as not to hold up asphalting activities. The drying apparatus according to the invention comprises an air-stream unit and a heater unit that are spaced apart from each other and that are both mounted on a vehicle that travels over the road surface. The air-stream unit is mounted on the front end of the vehicle and has an air knife that provides a continuous wall of air that pushes any water on the roadway in advance of the vehicle and/or off to the side. The heater unit is mounted at the rear end of the vehicle with one or more heaters mounted so as to direct heat downward onto the road surface. The heaters effectively dry any residual moisture on the road surface. Ideally, a paving vehicle follows close behind the drying apparatus to lay down the asphalt.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 3:
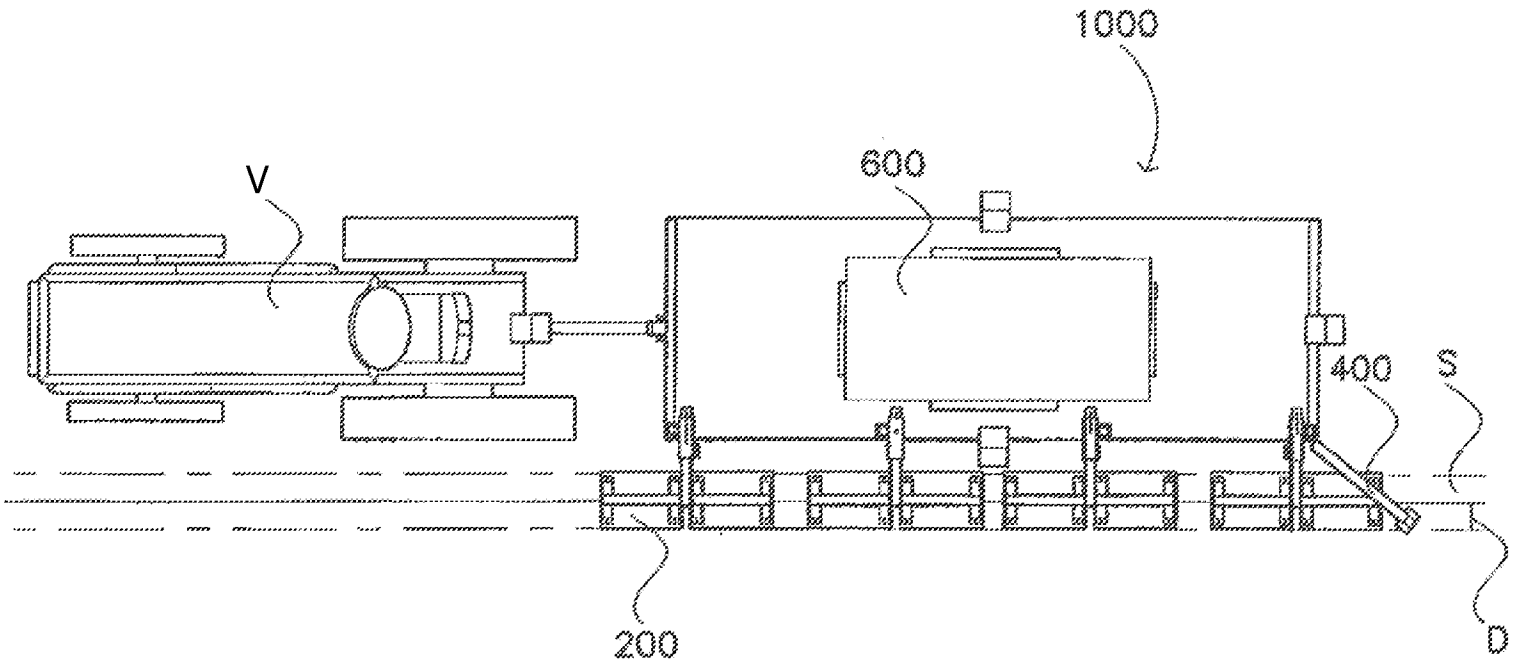
FIG. 3 is a top plane view of the seam sealer.
Figure 4:
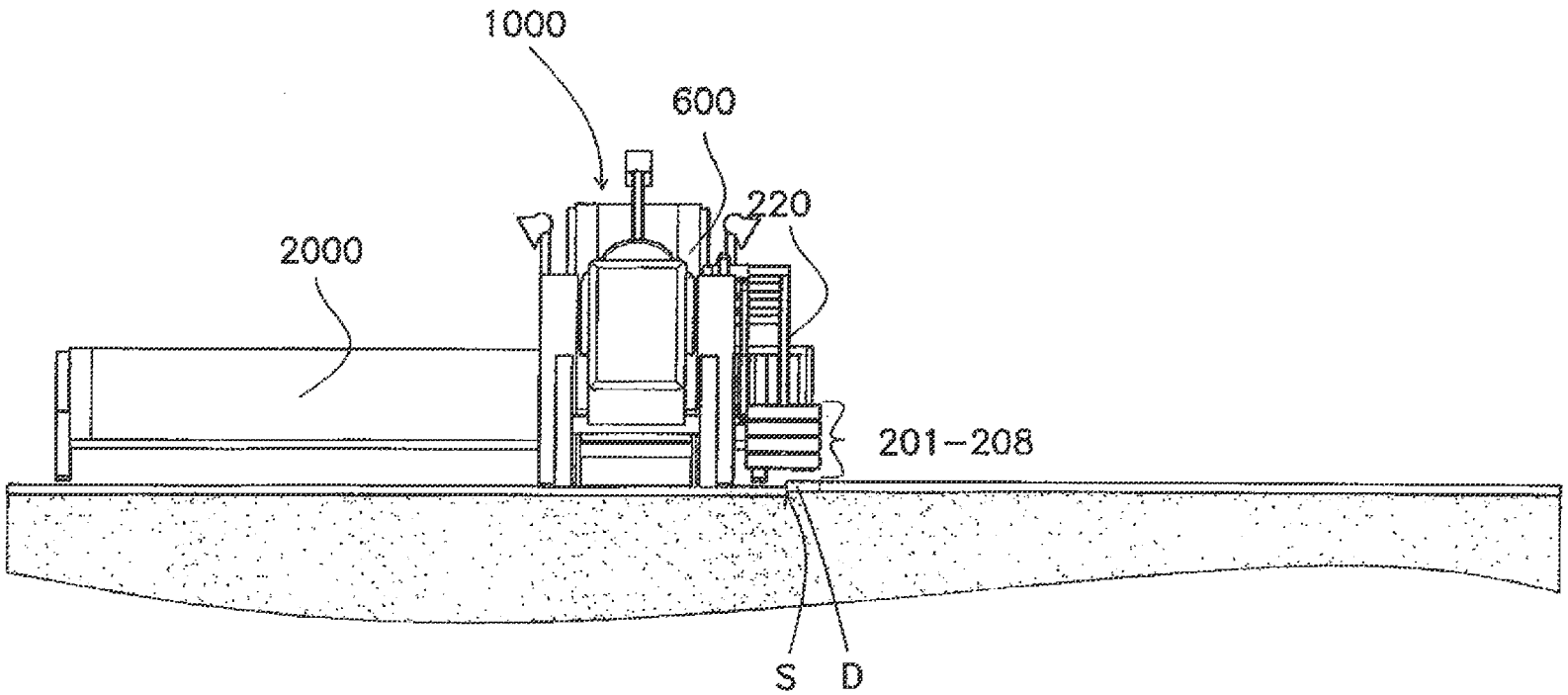
FIG. 4 is a front elevational view of the seam sealer according to the invention, showing the heaters positioned over the seam area and the paver following behind.

FIGS. 1, 2, 3 and 4 illustrate conceptually a seam sealer 1000 according to the invention. The seam sealer 1000 is moving alongside a seam area S in a roadway, in front of an asphalt paver 2000 that is laying down fresh hot asphalt. The seam sealer 1000 is shown being moved along the roadway by means of a tow vehicle V. Both the paver 2000 and the tow vehicle V are conventional equipment and, as such, are not included within the scope of the invention. The seam sealer 1000 may be constructed as a towable platform or trailer that is towed by a tow vehicle V or be incorporated into the moving vehicle itself. As shown in the FIG. 1, a first lane L1 of asphalt has been previously laid down. The asphalt in this first lane L1 is at road temperature, as is the road surface of a second lane L2 that is yet to be paved. The surface of the second lane L2 is not limited to a specific type of surface. It can be old pavement that is being covered with a new layer of asphalt or a gravel substrate. The seam sealer 1000 and the asphalt paver 2000 are moving along the second lane L2. A seam area S is shown comprising a narrow strip along each side of a solid line that extends between L1 and L2. In other words, the seam area S includes a strip of previously laid down asphalt in the first lane and a strip of still to be paved road surface in the second lane. The temperature of the road surface and of the previously laid down asphalt in the seam area S are at "road temperature," i.e., it may ambient temperature or be slightly warmer or cooler than the ambient temperature, depending on the season and the weather. FIG. 4 is a front elevational view that shows the seam sealer 1000 with the heaters 200 positioned over the seam area S, including an overlap dimension D, with the asphalt paver 2000 following some distance behind it.

The seam sealer 1000 comprises an electrical heater 200, a sensor 400, a control system 500 for controlling the heaters 200, and a power supply 600 for powering the heater 200 and other devices. The heater 200 will generally include two or more heaters, because this allows varying amounts of heat to be applied to the road surface, although it is understood, that the number and/or the capacity of the heaters in the series of heaters 200 may vary according to a particular application. For purposes of illustration, the heater 200 as described herein shall be a series of four heaters 201, 203, 205, 207, each of which may include multiple individual heaters. For example, if the capacity of the heater is too small for the desired heat output, two or more heaters may be provided within each heater, so as to create sets of heaters. In this way, the heaters 200 may now include, for example, four pairs of heaters 201-208, as shown in these FIGS. It is also possible that the first two heaters 201 and 203 may each comprise a single heater and the last two heaters 205 and 207 may each comprise a double heater 205/206 and 207/208 or vice versa.

Figure 1:
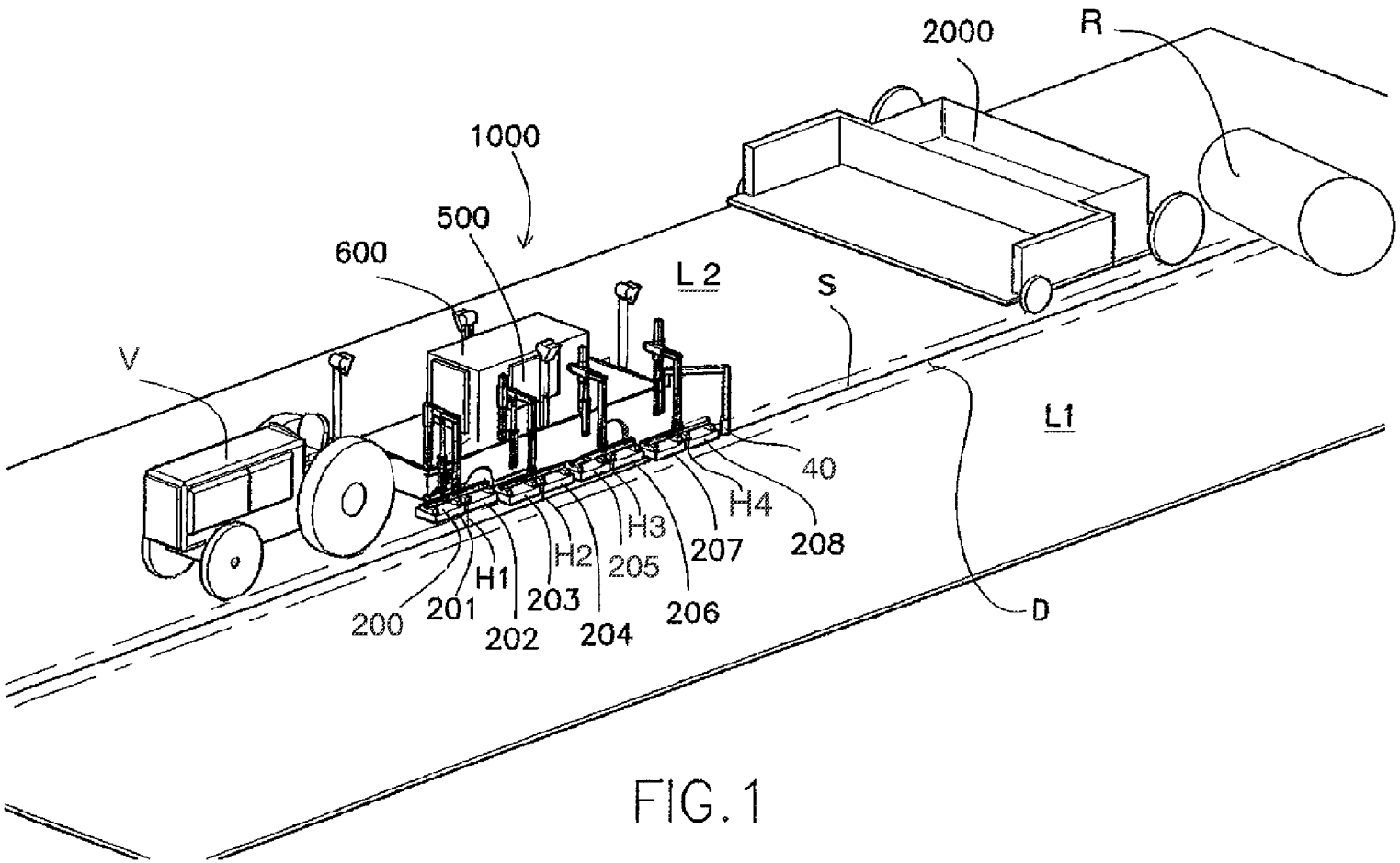
FIG. 1 is perspective schematic view of the seam sealer according to the invention, shown moving alongside the seam area of a road ahead of an asphalt paver.
Figure 2:
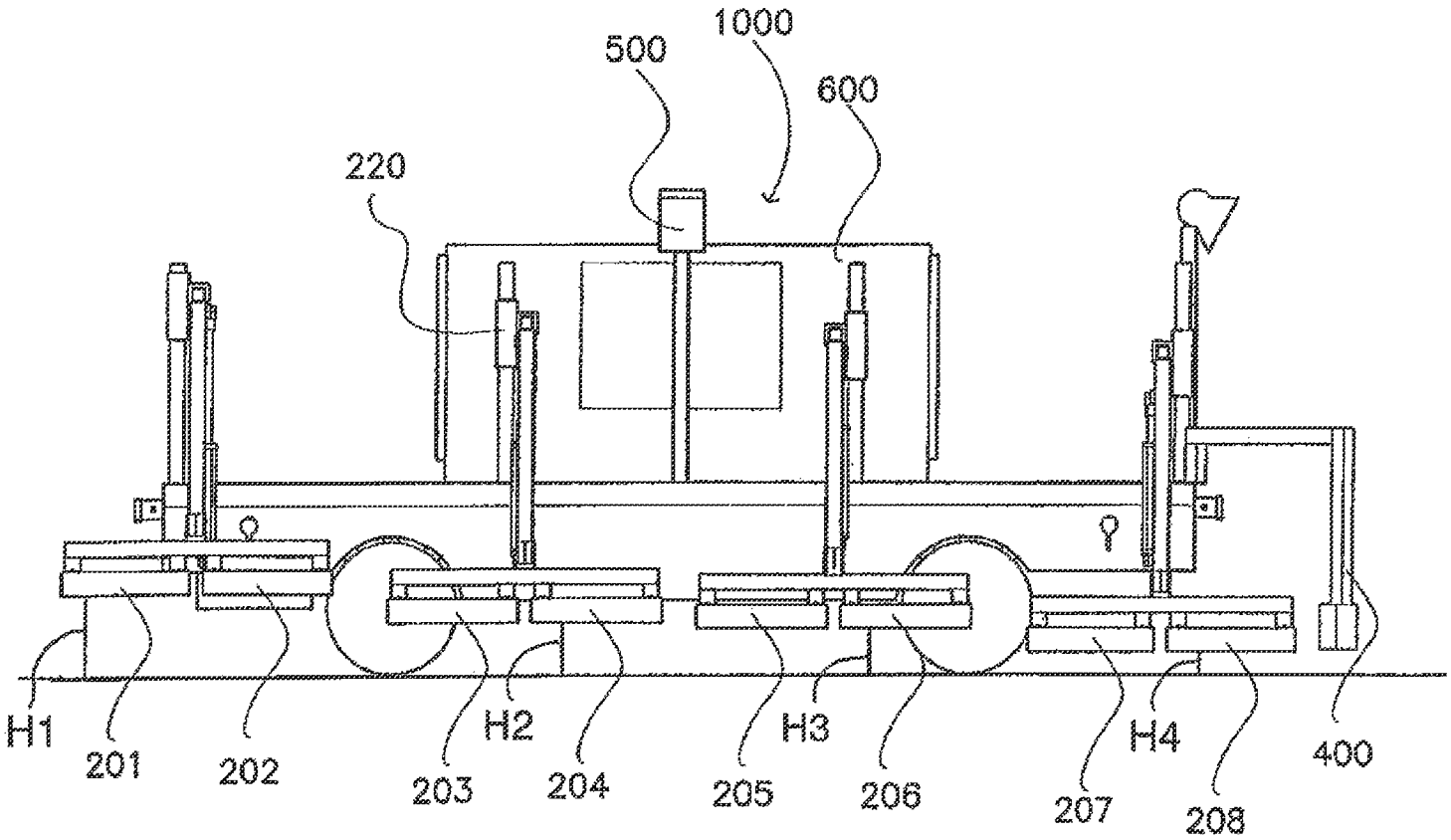
FIG. 2 is a side elevational view of the seam sealer of FIG. 1.

The heaters 200 may be positioned at varying distances to the ground surface. For example, the first heater 201 or 201/202 is a first height H1, the second heater 203 or 203/204 a second height H2, the third heater 205 or 205/206 a third height H3, and the fourth heater 207 or 207/208 a fourth height H4 from the surface of the seam area S. The heaters 200 are preferably radiant energy heaters, such as, for example, infrared heaters, and are preferably mounted on arms 220 that are hydraulically adjustable. Infrared frequency changes as the distance between heater and surface changes and providing the heaters 200 at varying heights "seasons" or cures the heat into the pavement at different infrared frequencies. Examples of suitable heights H1-H4 are sixteen inches, twelve inches, eight inches, and four inches. The heaters 200 have a heating head that provides a heat-radiating surface area that is great enough to provide radiation over the seam area S. The seam area S is shown in FIG. 1 as the area between two dashed lines and the solid line that indicates the edge of the asphalt layer in the first lane L1. FIG. 3 shows the heating heads of the heaters 200 extending into the first lane L1 for a distance that corresponds to the overlap dimension D. An example of a suitable overlap dimension is nine inches. Thus, the road surface in the seam area S, i.e., a narrow strip of the sub-surface in the second lane 2 and a narrow strip of the previously laid down first lane L1, are heated to the same temperature, this temperature being close to the temperature of the fresh hot asphalt that is to be applied to the second lane L2. The heaters 200 are shown in a configuration that applies progressively greater heat to the road surface. It may be desirable to apply the greatest amount of heat first to bring the pavement up to the desired temperature and then progressively lesser amounts as needed to maintain the temperature.

Other types of electric heaters may be used and the heaters do not necessarily have to be positioned at varying distances to the ground surface. Doing so provides certain advantages, discussed above, but it is also possible to provide a series of electric heaters that are positioned at the same height relative to the ground surface. It is also possible to provide a series of heaters, all set at the same height above the road surface, but that vary in the heat output, so as to emulate the effect of the infrared heaters that are positioned at varying heights. A particular advantage of electric heaters is that the heat is radiated in a straight path through air and, thus, in contrast to gas heaters, windy conditions will not significantly diminish the amount of heat that is radiated onto the pavement. Providing heat over a period of time from the series of heaters 200 also ensures that the heat penetrates to a depth that is necessary to obtain a good bond with the fresh hot asphalt that is being laid down.

The control system 500 and temperature sensor 400 control the amount of energy that is supplied to the heater 200 by the power supply 600. The temperature sensor 400 is mounted such, that it extends into the overlap dimension D close to the asphalt surface or generally into the seam area S. The temperature sensor 400 measures the surface temperature and sends corresponding signals to the control system 500. If the measured temperature varies from the set point for the predetermined or desired temperature, the control system 500 adjusts the power to be sent from the power supply 600 to the heaters 200 accordingly. Various types of sensors may be suitable for this application, but one particularly suitable sensor is a laser temperature probe. The combination of controlling the amount of power supplied to the heaters and controlling or adjusting the distance of the heating heads from the surface of the pavement to be heated enables close control of the road surface temperature.

In conventional paving systems, the previously laid down asphalt in the first lane L1 is heated by a road roller during the rolling process, that is, after the asphalt for the second lane L2 has been applied. Heating the road surface ahead of the paver 2000 with the seam sealer 1000 has the advantage of allowing the heat to be applied such, that it penetrates farther into the pavement and, ideally, completely through the layer of the previously laid down asphalt in the first lane L1 and through the top layer of substrate in the second lane L2. Although this is by no way intended to be limiting, use of the seam sealer 1000 in a paving operation will be somewhat as follows: The paver 2000 travels at 50 ft/min and, ideally, somewhere between 50 and 75 feet behind the seam sealer 1000. Following the paver is a conventional road roller R that rolls over the seam area S and presses the seam to a smooth finished surface. Prior to applying the fresh hot asphalt in the second lane L2, the road surface in the seam area S, which includes previously laid down asphalt in the first lane L1 and the existing road surface or substrate in the second lane L2, will initially be at road temperature. The seam sealer 1000 heats the road surface in the seam area S to a pre-determined temperature that is selected such that the temperature of the road surface will be hot enough to allow the fresh hot asphalt from the paver 2000 and the previously laid down asphalt in the first lane L1 to form a molten mass, which is then pressed into a smooth, finished and seamless surface by the road roller R. The predetermined temperature is adjusted according to the parameters of the specific paving operation. For example, on cool windy days, the seam area S may be heated a greater number degrees above the temperature of the fresh hot asphalt in the paver 2000, to ensure that the road surface in the seam area S is at the proper temperature when the fresh hot asphalt is applied. On hot windless days, the seam area S may be heated to just the temperature of the fresh hot asphalt, or even to a temperature that is a few degrees lower, if it is known that the temperature of the heated road surface will still be hot enough when the fresh hot asphalt is applied to it to allow the fresh hot asphalt and pre-heated previously laid down asphalt to form the desired molten mass.

The power supply 600 is preferably a diesel generator, which generates the electrical power for the heaters 200, a lighting system, if one is provided, the sensor 400 and the control system 500. Additional sensors 700 may also be provided. For example, the Department of Transportation (DOT) has specific guidelines on the temperature of the asphalt that is applied. A GPS receiver 701 may be integrated into the sensor 400 and control system 500, so as to allow data that correlates temperature and GPS data points to be gathered and stored for future analysis. Similarly, a motion sensor 702 may also be incorporated into the sensor 400 and linked to the control system 500, to control the energy output of the heaters 200 as a function of the speed of travel. For example, a certain energy output is required when moving at 50 feet/hour, the desired speed of the paving operation. When the speed of the seam sealer 1000 slows down or stops, because of some obstruction down the line, the energy output of the heaters 200 may be reduced, to prevent the asphalt from overheating, yet keep the heaters warm enough to very quickly get up to the desired heating level, as soon as the seam sealer 1000 is in motion again.

The following information is provided for enablement purposes only. Information as to size and type of heater and size and type of generator is not intended to be a limitation on the scope of the invention. An embodiment of the seam sealer 1000 according to the invention is as a four-wheeled trailer pulled by a tractor with a three-point hitch. The trailer may be pulled from each end. To this end, the temperature sensor 400 is mountable on each end of the trailer, so that the trailer may be towed in both directions. The tractor provides the hydraulic power to operate the hydraulic controls for the controlled heaters 200. A series of heaters are spaced along one side of the trailer. In the embodiment shown, four paired sets of infrared heaters 201-208 were used, each set of heaters being positioned a progressively shorter distance from the road surface. For example, the sets of heaters 201/202, 203/204/205/206, and 207/208 are set to sixteen, twelve, eight, and four inches, respectively, above the surface of the overlap area. It is understood that the series of heaters may include any number of heaters and that the heaters do not have to be paired sets. The size of each heater 201-208 is 5400 Watts. The heating heads of the heaters 201-208 have a heat-radiating surface area that will heat a sufficiently wide seam area A and, in the embodiment shown, is 18×12 inches, so that the overlap onto each lane L1 and L2 is nine inches. An example of a suitable infrared heater is a medium wavelength V-Series heater from Solar Products, Inc. of Pompton Lakes, N.J. The generator has a 314 kW output capacity. An example of a suitable generator is a Kohler Emergency Standby Diesel Generator Set, Model 10REODB from Kohler Generators of Wakefield, Mass. The hydraulic power for operating the hydraulically driven arms for the heaters 200 is a conventional system that is typically available on tractors. Hydraulic systems are well known and the specifics of the hydraulic arms for positioning the heaters 200 are not included within the scope of the invention and are not described herein in detail. The heaters 201-208 are adjusted up and down to best fit the particular paving application. Once the height is adjusted, the amperage is adjusted to achieve the desired exit temperature. The pre-heated, previously laid down asphalt in the first lane L1 has time to normalize or cure, in other words, for the temperature penetrate into the asphalt, asphalt will now bond together in a molten state, resulting in a water-tight, smooth, seamless bond when the road roller presses it together.

Figure 5:
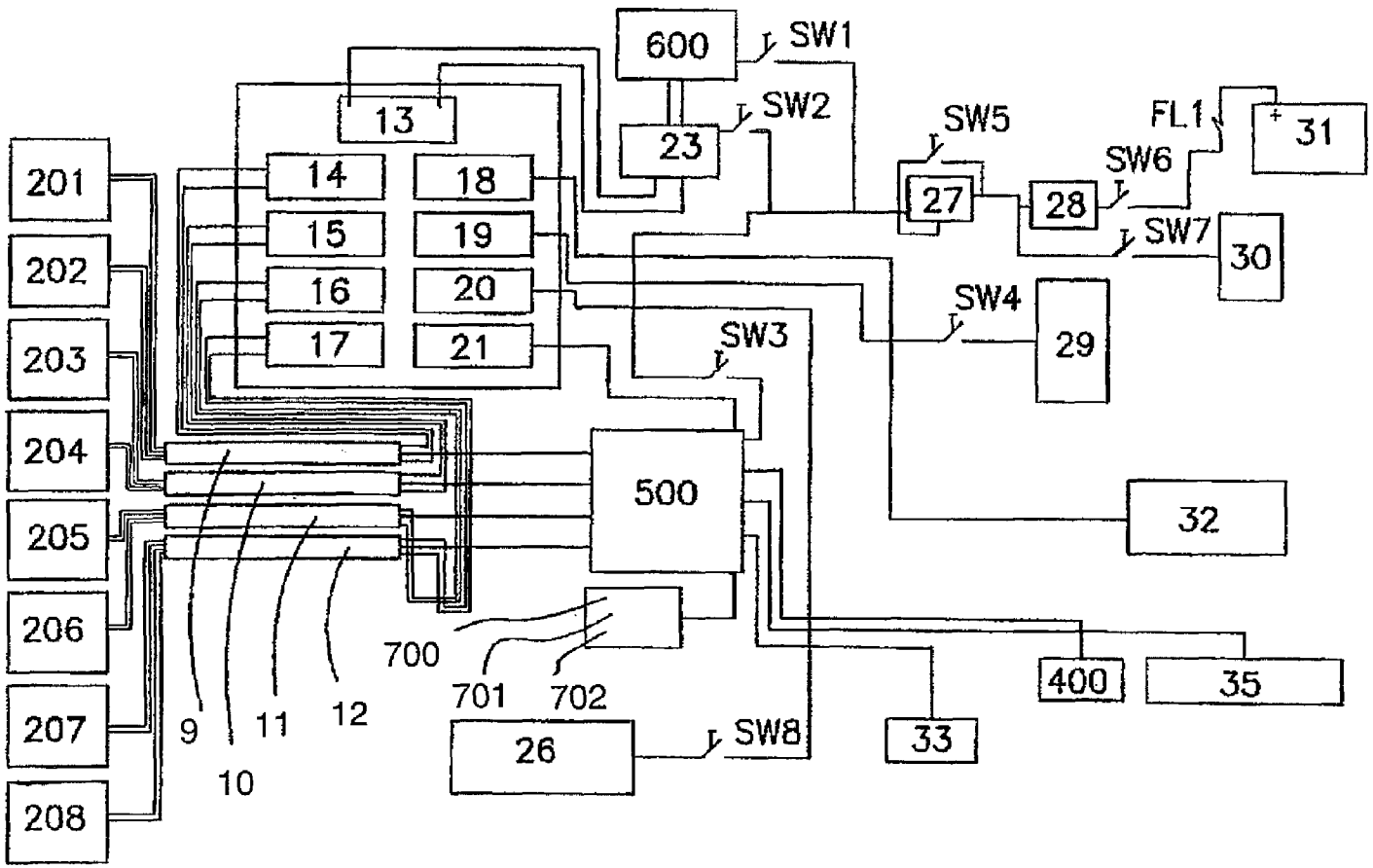
FIG. 5 is a block diagram of the electrical systems.
Figure 6:
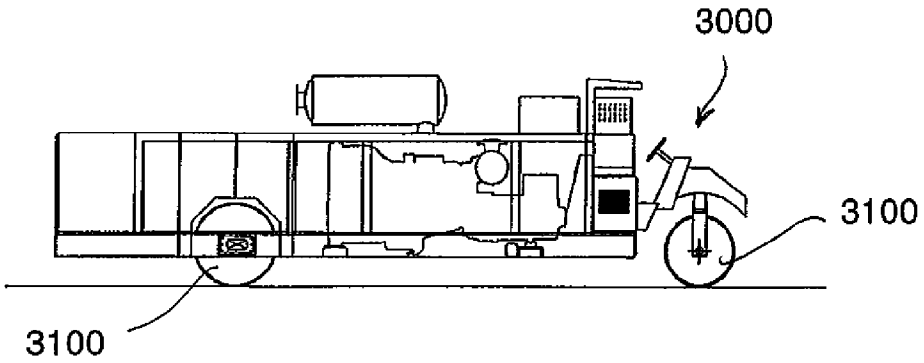
FIG. 6 is a side elevation view of a seam-sealing roller vehicle according to the invention.
Figure 7:
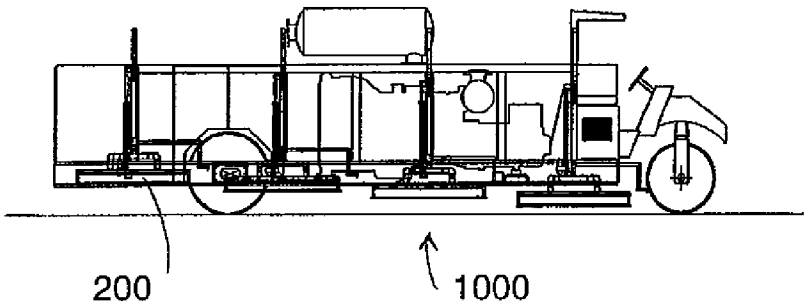
FIG. 7 is the same view of the seam-sealing roller vehicle of FIG. 1, but with the seam sealer according to the invention mounted on the vehicle.
Figure 8:
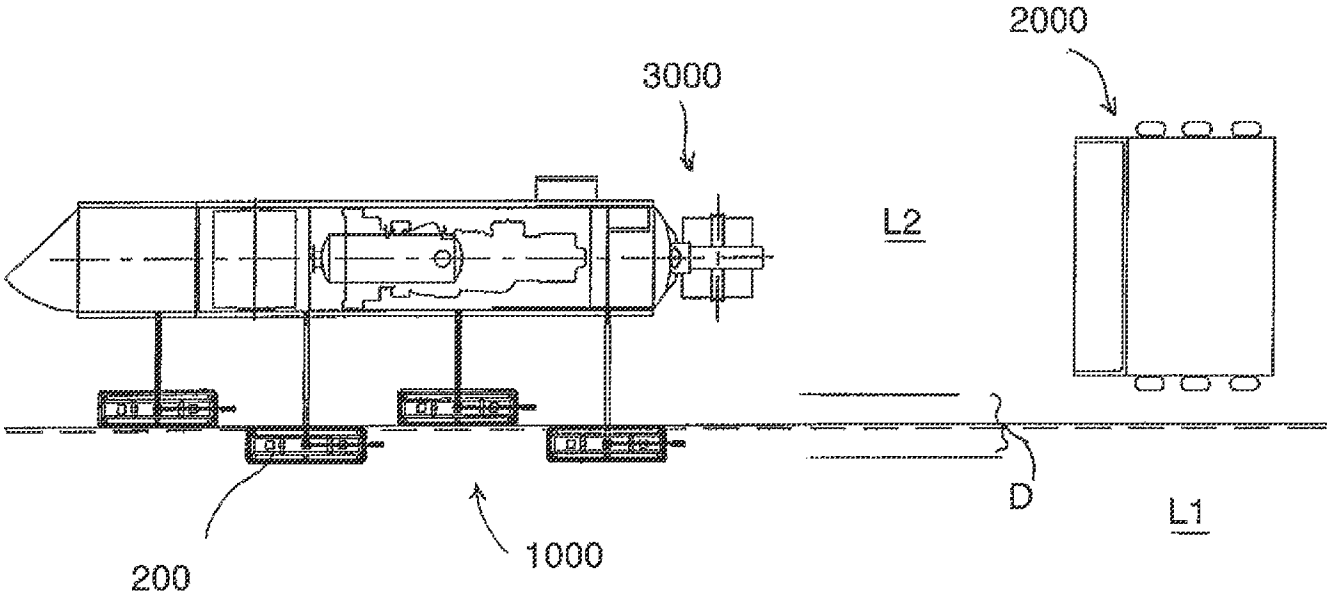
FIG. 8 is a top plan view of the seam-sealing roller vehicle with seam sealer, traveling close behind a paving vehicle.

FIG. 5 is a block diagram, illustrating the various electrical components of the seam sealer 1000. Examples of the electrical components are as follows:

9 heater head relay 1 & 2
10 heater head relay 3 & 4
11 heater head relay 5 & 6
12 heater head relay 7 & 8
13 200 amp main circuit
14-17 50 amp circuit breakers
18-21 20 amp circuit breakers
23 240 V power feed relay
26 hydraulic pump
27 reset machine relay
28 master control relay
29 spot light
30 12 V LED lights
31 battery from generator
32 120 V ground fault resetable 4×receptacle
33 USB communication port
35 LED temperature display
SW1 start generator enable switch
SW2 enable 240 V feed from generator switch
SW3 on/off heater heat switch
SW4 on/off light switch
SW5 reset machine switch
SW6 emergency stop switch
SW7 LED lights on/off switch
SW8 on/off hydraulic pump switch
FL1 fusible link FIGS. 6-8 illustrate the seam sealer 1000 mounted on a seam-sealing roller vehicle 3000. This is a particularly advantageous embodiment, because it allows the seam sealer 1000 to be transported over freshly laid, still warm asphalt, directly behind the paving vehicle 2000, rather than in front of it, as described above. The vehicle 3000 travels over the freshly laid, still warm asphalt, so that the seam sealer 1000 heats a strip of roadway that has the width of the overlap dimension D. The heaters 200 may be arranged in an offset pattern, as shown in FIG. 8. With this arrangement, some of the heaters heat the freshly laid asphalt in the second lane L2 and some heat the previously laid asphalt in the first lane L1. The road roller R then comes along behind the specially modified vehicle 3000 and fuses the freshly laid asphalt with the underlying older asphalt.

The seam-sealing roller vehicle 3000 is any suitable vehicle that has the capacity to carry the seam sealer 1000 that has been outfitted with large rollers 3100 Because the asphalt is still warm, a heavy load on a wheeled vehicle would leave depressions in the new pavement. The seam-sealing roller vehicle 3000 may be a single-axle tractor with a single-axle trailer bed or a two-axle vehicle, with a roller 3100 rather than wheels at each axle. The rollers 3100 allow the seam-sealing roller vehicle 3000 to travel on freshly laid, still warm asphalt, without leaving undesirable depressions from tires. The weight of the vehicle is distributed evenly across the width of the roller 3100, so that the roller leaves no depressions.

FIGS. 9-12 illustrate dryer apparatus 4000 for drying a road surface. Asphalt will not properly adhere to a wet or damp surface. For this reason, a drying procedure is carried out before the asphalt is laid down and the seam sealing apparatus 1000 employed to seal an asphalt seam. The drying apparatus 4000 according to the invention is mounted on a vehicle V that travels along the roadway. It is shown in the figures as mounted on a conventional vehicle, such as a tractor trailer rig, but it may also be mounted on a vehicle specially constructed for it, for example, a vehicle that is a wide as a conventional lane, or on the seam-sealing roller vehicle 3000 shown above, or on a truck. The vehicle carrying the drying apparatus will simply be referred to hereinafter as a vehicle V, regardless of the type of vehicle that is used.

The drying apparatus 4000 is mounted on the vehicle V and includes apparatus for a two-step process for obtaining a dry road surface. The first step is to push liquid, i.e., water, oil, other liquids, away from the road surface; the second step is to follow up with a dryer, to ensure that the surface is completely dry. Typically, the liquid being removed from the road surface is water, and, although the drying apparatus 4000 may be used to remove other types of liquid from the road surface, the term "water" will be used hereinafter and shall be understood to include other types of liquid.

The drying apparatus 4000 comprises an air-stream unit 4100 and a heater unit 4200. The air-stream unit 4100 includes an air jet or air knife 4110 and a power unit (not shown) to force a strong stream of air or other gas through a plurality of jets 4112, so as to distribute the stream of air across the width of the air knife 4110. The air stream is powerful enough to push liquid across the surface and the jets 4112 are directed at an angle to the vertical plane, so as to move the liquid in advance of the vehicle. As shown in the FIGS. 9 and 11, the air knife 4110 is mounted on the front end and the heater unit 4200 on the rear end of the vehicle V. As the vehicle V travels across the roadway, the air knife 4110 pushes the liquid forward along the road surface, leaving behind a surface that does not have pools or drops of liquid on the surface, but that might still have some moisture on it. The air stream from the jets 4112 effectively provides a continuous wall of air that is projected downward, so that, even if there are irregularities in the road height, such as, for example, shallow hollows in which water can collect, the air stream will reach the hollow and force the water out. The air knife 4110 may be adjustable in width, so that it can be extended out to one or both sides of the vehicle V. It may also be tiltably mounted, so that it pushes the water in front of and off to one side of the road surface, so that the water can flow into the ditches that are typically provided alongside roadways.

Figure 11:
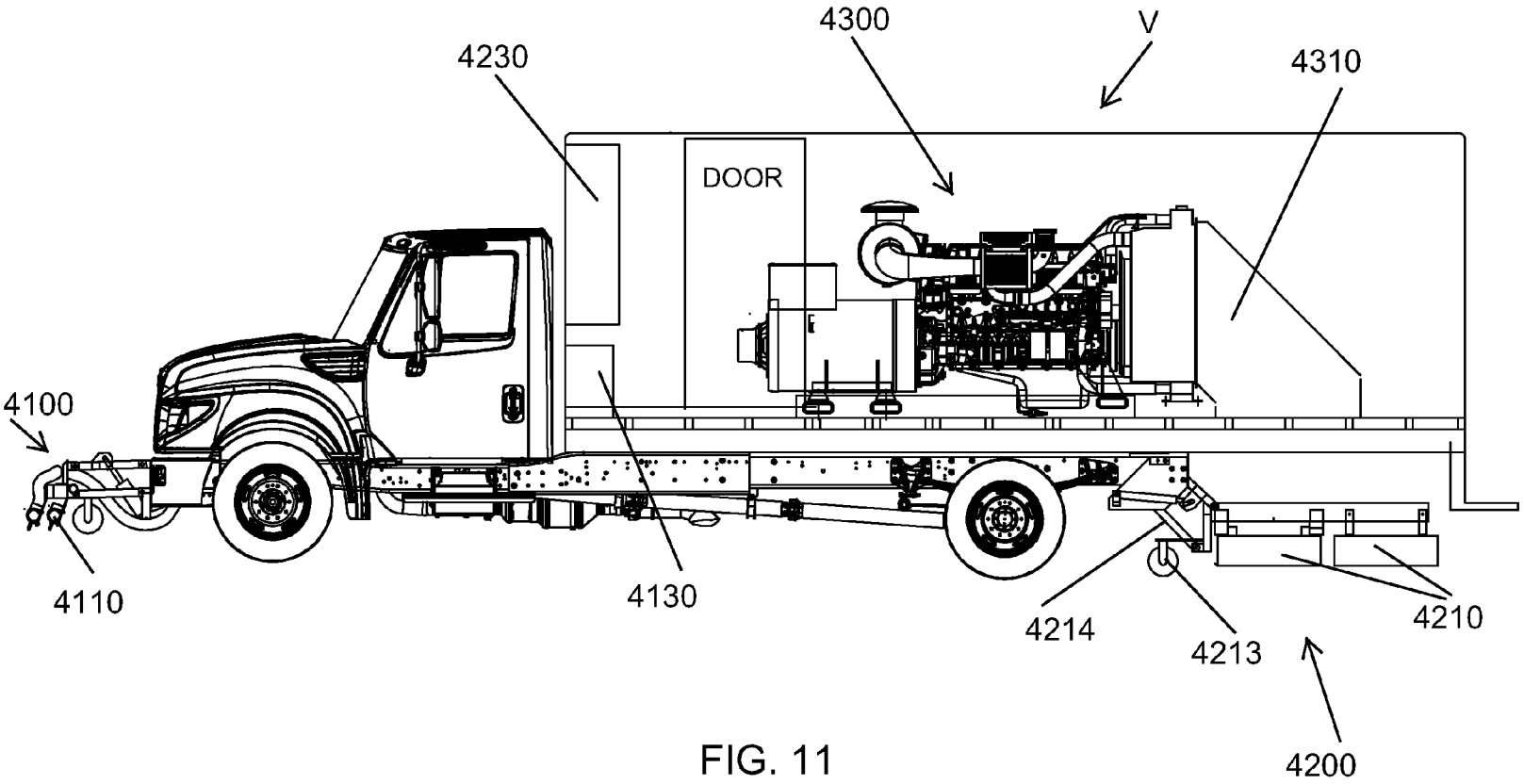
FIG. 11 illustrates drying heaters mounted on the underside if the backend of the trailer shown in FIG. 9, and lowered to a deployed position for heating the road surface.
Figure 12:
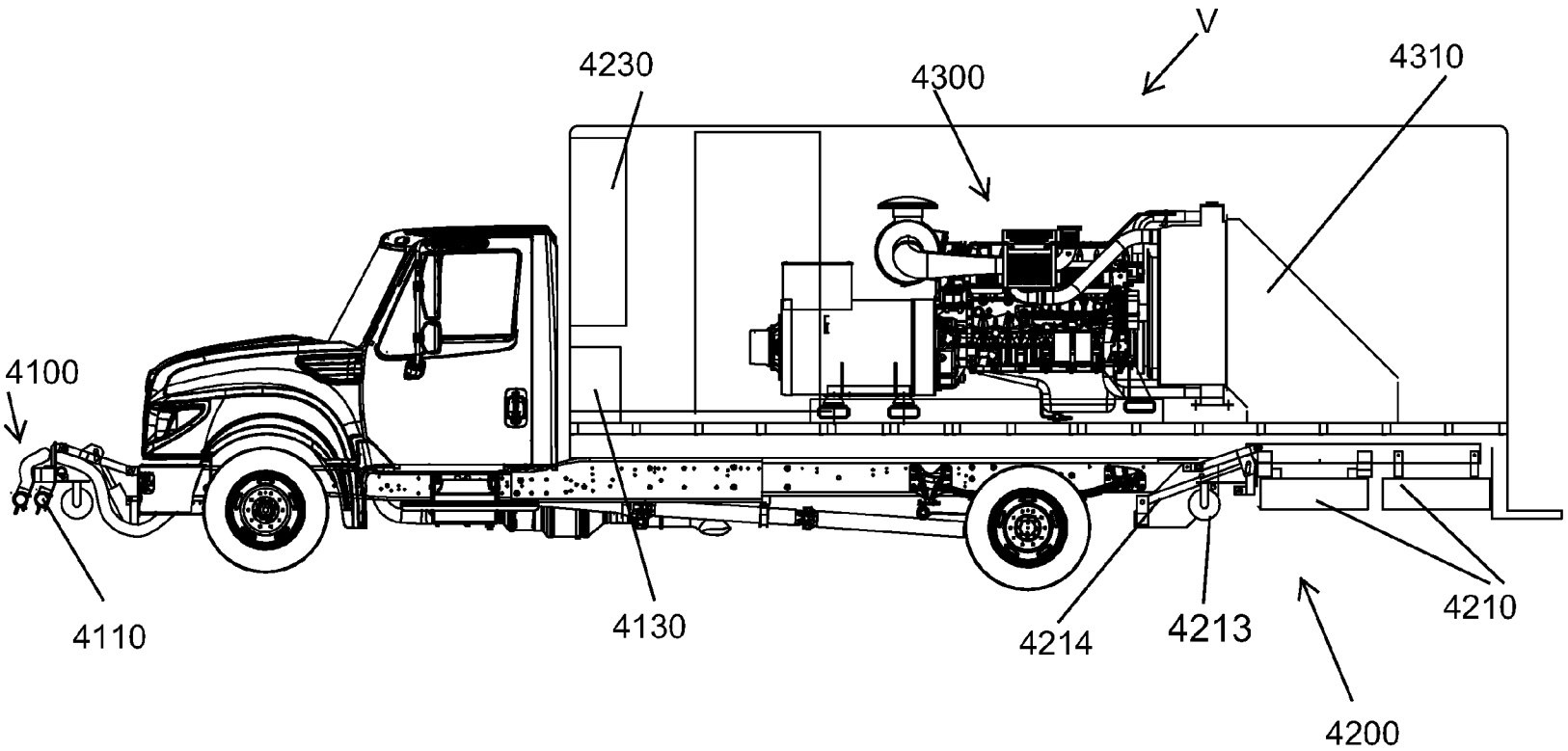
FIG. 12 is a side view of the drying heaters, retracted to a non-deployed position.

Forward travel of the vehicle V now carries the heater unit 4200 over the surface just cleared of water. The heater unit 4200 includes one or more heaters 4210 have and ideally has a width that corresponds approximately to the width of the air knife 4120. The heaters 4210 are movably mounted under the back end of the vehicle V and direct heat downward onto the road surface. FIGS. 11 and 12 show two heaters 4210 mounted on the vehicle V, in a lowered position, ready for deployment, and in a raised position.

Figure 9:
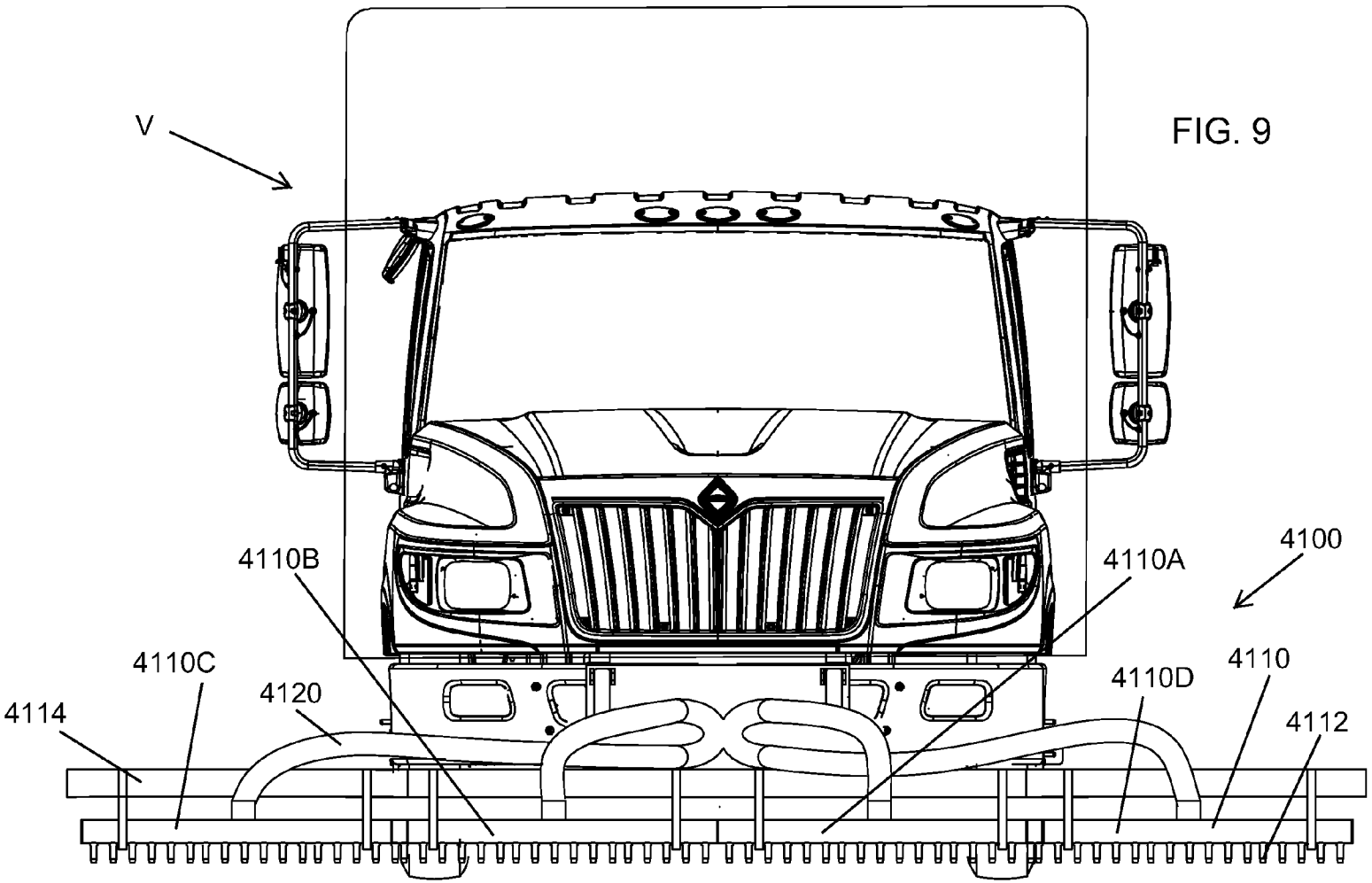
FIG. 9 is an illustration of an air knife mounted on a conventional vehicle.

As can be seen in FIG. 9, the air knife 4110 of the air-stream unit 4100 is height-adjustably mounted on the bumper of the vehicle V so that the tips of the air jets 4112 may be lowered to an operational position that is several inches above the road surface or raised to a deployed position that is a distance from the ground that ensures high clearance from the ground. When lowered to the operational position, the jets are brought close enough to the ground to provide sufficient space to avoid interference due to irregularities in the height of the road surface, yet be low enough to provide a stream of air that effectively moves the water along the surface. Details of the air-stream unit 4100, i.e., the power unit and the hoses and connectors are not shown or described in any detail, because such units are widely known and a person of skill in the art will know how to implement an air-stream unit that has sufficient power to achieve the desired results. FIG. 9 does show hoses 4120 that are connected directly to the air knife 4110. In the embodiment shown, the air knife 4110 is constructed in sections 4110A-4110D, with a hose 4120 feeding air to each section. The sections 4110A and B extend approximately the width of the vehicle V, whereas the sections 4110C and D are wing sections that may be folded out, to one or both sides of the vehicle V, as needed, so as to extend across the full width of a road lane, i.e., 14 feet, and folded back in toward the center of the vehicle when the extra width is not desired. FIG. 11 shows the air knife 4110 folded in front of the vehicle, recognizable by the double row of air jets 4112.

Figure 10B:
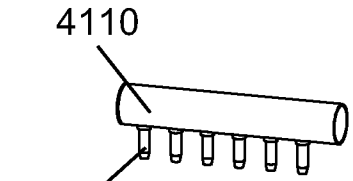
FIG. 10 illustrates an air jet for moving liquid away from the road surface.
Figure 10A:
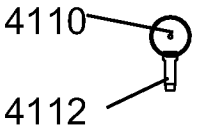
Figure 10:
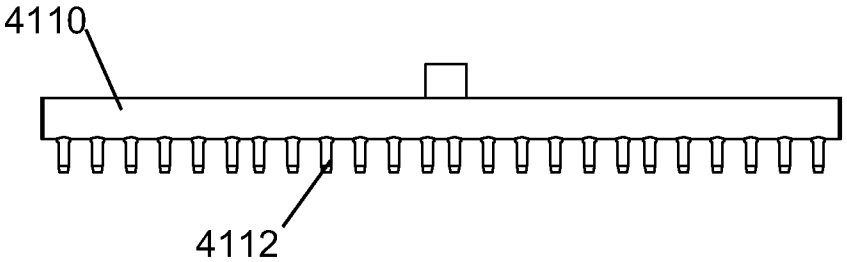

FIGS. 10, 10A, and 10B illustrates an industrial air knife, such as the one used in this air-stream unit. FIG. 10 is a front plane view, FIG. 10A a side plane view, and FIG. 10B a perspective view. Such industrial air knives are typically manufactured to desired specifications. An example of a suitable air knife is one that is manufactured by JetAir Technologies, LLC of Ventura, Calif.

FIGS. 11 and 12 show a partial cut-away side elevation view of the vehicle V, fully equipped with the air-stream unit 4100 and the heater unit 4200. FIG. 11 shows the air-stream unit 4100 and the heater unit 4200 in their respective deployed positions and FIG. 12 shows the units retracted to their stowed positions. Depending on the intended application of the dryer apparatus 4000, the heater unit 4200 is mounted to the rear of the vehicle, behind the air-stream unit 4100. The heater unit 4200 includes one or more heaters 4210 that are mounted so as to provide heat to the road surface, and are preferably configure to provide heat for the width of the air knife 4110. The heaters are preferably radiant energy heaters, as described above with the heaters 200, whereby the term "radiant energy heater" includes infrared heaters, resistive heaters, microwave heaters, and any suitable heater that generates heat by radiation, i.e., by transmitting a stream of photons or particles through air. The heaters 45210 are preferably mounted hydraulically, so as to be movable in the vertical direction. Extra heaters 4210 may be mounted on the sides of the vehicle V to accommodate the width of an air knife 4110 that extends out beyond the side boundaries of the vehicle.

As mentioned above, the heaters are preferably infrared heaters, either electric or fuel powered, and more preferably electric infrared heaters. Infrared heaters have not been hitherto used to dry road surfaces, because it is known that water does not absorb the wavelengths of infrared energy very well. Standing water is more likely to reflect the energy, rather than absorb it. The combination of the air-stream unit 4100 and the infrared heater 4210, however, eliminates this difficulty. The air-stream unit pushes standing water away from the surface area over which the infrared heater travels. Removing the standing water reduces the amount of water to be evaporated and, consequently, reduces the amount of energy required. The thin layer of moisture that remains on the surface is not sufficient to reflect the energy and, therefore, does not interfere with the radiant heat from the heater 4210 penetrating into the surface to heat it sufficiently to evaporate the water.

Electric infrared heaters are preferred, because of the ability to control the output across the full range extending from 0 to 100% output, all the while maintaining even heat across the heater. The intended use of the drying apparatus 4000 is to dry road surfaces prior to laying down a layer of surfacing material. Asphalt has been mentioned previously as the surface layer, but, in reality, other layer materials are also used to pave roads. For example. when paving a bridge, a waterproofing membrane is laid over the concrete bridge and asphalt on top of the waterproofing membrane. Before each layer is put down, the underlying layer needs to be dried, to ensure a good bond between the layers. Thus, the concrete bridge surface is dried, the waterproofing membrane laid over the concrete and dried, and then the asphalt. laid down. Each of these materials can withstand heat to a different degree and wavelength. The waterproofing membrane, for example, is extremely sensitive to heat. The ability to change the output, i.e., to reduce the wavelength and temperature to, for example, 100 degrees Fahrenheit, without losing efficiency, enables each layer to be dried completely at the appropriate temperature and wavelength, thereby avoiding damage to the layer by applying excessive heat.

The ability to carefully control the output of the radiant energy heater 4210 also allows the drying apparatus 4000 to move at various speeds, or even to come to a halt, during the heating operation, without overheating or underheating the surface. As the drying apparatus 4000 slows down, the output of the radiant energy heaters 4210 is reduced accordingly, and when the apparatus comes to a stop, the radiant energy heaters 4210 will provide just enough energy to maintain the desired temperature, without cycling the heaters on and off and without losing any efficiency when operating at less than full capacity.

A temperature control system 4230 is used to continuously monitor and adjust the temperature of the radiant energy heaters 4210, rather than simply timing the heaters on and off, as must be done with propane heaters, to maintain the desired temperature. The temperature control system 4230 allows digital selection of the desired road surface temperature. An infrared sensor is placed a certain distance above the road surface and measures the surface temperature. Data from the sensor is used by the temperature controller 4230 to send a signal to a power regulator to increase or decrease the heat output of the radiant energy heaters. This method of temperature control avoids an overheating of the surface, something that may happen with other types of heaters.

A control mechanism 4212 may be used to control the height of the heaters 4210 when they are lowered to a deployed position. In the embodiment shown, the control mechanism 4212 is a wheel 4213 mounted at the end of a hydraulic arm 4214. The heaters 4210 are offset a predetermined distance from the wheel 4213. When the wheel 4213 touches the ground, the hydraulic system stops lowering the heaters 4210, thereby bringing the heaters to a predetermined distance above the road surface.

The radiant energy heaters 4210 heat the surface directly, thereby raising the temperature of the surface above the dew point, which effectively prevents moisture from forming on the surface. This is important when working under conditions of high humidity and particularly in cool, humid air, when the dew point is high. In night-time paving operations, for example, the dew point is higher than the temperature of the surrounding surface. Under these conditions, when drying apparatus moves away from the dried surface, the surface is exposed to the cool, moist air at a time when there is no sun to dry or heat up the surface and, as a result, moisture collects on the surface. The heater unit 4200 according to the invention not only dries the surface, but raises the temperature of the surface to a safe, desired temperature that is well above the dew point, effectively preventing the moisture from collecting on the surface for an extended period of time.

The drying apparatus 4000 may also be used to dry an asphalt tack coat in cool humid conditions. The asphalt tack coat is a water-asphalt emulsion that acts as a glue to bond layers of pavement together. It is heated in a tank and sprayed onto a surface. The water in the emulsion has to evaporate out for the asphalt tack coat to set properly. The drying apparatus 4000 aids in curing this asphalt tack coat by pre-heating the surface, so that the asphalt tack coat is sprayed onto a warm, dry surface. It is also foreseeable, to run the drying apparatus behind the vehicle spraying the asphalt tack coat, to facilitate curing the coat in less than ideal paving conditions. The asphalt tack coat is very sensitive to intense heat, as it readily absorbs heat and may boil away when exposed to excessive heat. The intensity of the air knife 4100 as well as the temperature output of the heater unit 4200 are both adjustable to the specific surface material and paving conditions, making the drying apparatus 4000 particularly well-suited for this operation.

A diesel engine/generator 4300 is used to power the hydraulic and electrical systems that operate the air-stream unit 4100 and the heater unit 4200. To aid in the drying process, hot dry air from the diesel engine is captured in a duct 4310 and directed through an opening in the floor of the vehicle down and across the area beneath the heaters 4210. Using just the heaters alone, in a situation with no air movement, the moisture that evaporated by the heaters remains trapped under the heaters. The air beneath the heaters becomes saturated with this moisture, to the point where they are not able to hold or remove the moisture. This inhibits the drying process significantly, because there is no place for the moisture to go. The hot dry air sweeping beneath the heaters transports the moist air out from under the heaters and away from the drying site. This synergistic effect of simultaneously heating the surface and sweeping hot dry air between the surface and the heaters effectively removes moisture from the drying area, thereby increasing the drying capability of the drying apparatus 4000.

Hydraulic systems, temperature control systems, and diesel-generator sets are well known and it is not necessary to disclose details of these systems.

The intended configuration of vehicles for an asphalting operation is to have the vehicle V dry a road surface with the drying apparatus 4000. Following closely behind the vehicle V with the drying apparatus is the paver 2000 that is laying down the asphalt. Following closely behind the paver is a vehicle carrying the seam sealer 1000. This intended use is, however, not limiting. Other uses of the apparatus are within the scope of the invention. For example, the apparatus 4000 may be used to keep airport runways clear of ice and snow. In this case, the radiant heaters may be mounted forward of the air knife, so that any snow or ice is first melted and then pushed to the side by the air knife, which is mounted behind the heaters.

It is understood that the embodiments described herein are merely illustrative of the present invention. Variations in the construction of the seam sealer may be contemplated by one skilled in the art without limiting the intended scope of the invention herein disclosed and as defined by the following claims.

What is claimed is:

1. Apparatus for drying a road surface which has a liquid thereon, the apparatus comprising:

an air knife, a compressor, a radiant energy heater, a control system, a temperature sensor, and a power generator;

wherein the air knife is for providing a stream of unheated gas sufficiently forceful to push the liquid from the road surface;

the compressor is for supplying the unheated gas to the air knife;

the radiant energy heater is for transferring a sufficient amount of heat energy into the road surface to cause a sufficient temperature increase of the road surface to result in the evaporation of any residual liquid remaining on the road surface after the unheated gas is applied to the liquid on the road surface, wherein the radiant energy heater does not come into direct contact with the road surface and only minimal radiant heat energy is transferred to subsurface regions of the road;

the power generator is for providing power to the radiant energy heater so that the radiant energy heater can produce heat energy;

the temperature sensor is suitably configured to determine a surface temperature of the road surface, and the control system is suitably configured to automatically adjust the amount of heat energy transferred by the radiant energy heater into the road surface based on the surface temperature of the road surface as determined by the temperature sensor, whereby a predetermined desired temperature of the road surface is achieved.

2. The apparatus of claim 1 wherein the temperature sensor is a laser temperature probe.

3. The apparatus of claim 1 wherein the temperature sensor is an infrared temperature sensor.

4. The apparatus of claim 1 further comprising a control mechanism, wherein the control mechanism is for controlling the distance of the radiant energy heater from the road surface.

5. The apparatus of claim 4 wherein the control mechanism comprises a hydraulic system for raising and lowering the radiant energy heater.

6. The apparatus of claim 1 wherein the control system is for adjusting the amount of power provided by the power generator to the radiant energy heater to raise or lower the amount of heat energy transferred by the radiant energy heater into the road surface.

7. The apparatus of claim 6 wherein the control system incorporates a microprocessor which is for receiving information from the temperature sensor and for using that information to adjust the amount of power provided by the power generator to the radiant energy heater.

8. The apparatus of claim 1 wherein the radiant energy heater includes a plurality of radiant energy heaters, wherein the control system is for adjusting the amount of heat energy transferred by the radiant energy heaters into the road surface by selectively cycling one or more radiant energy heaters on and off.

9. The apparatus of claim 8 wherein at least one of the plurality of radiant energy heaters is positioned a different distance from the road surface than at least one other radiant energy heater.

10. The apparatus of claim 1 further comprising:

a motion sensor, wherein the motion sensor is for providing to the control system an indication of the apparatus' speed relative to the road surface such that the control system takes into account the speed of the apparatus in automatically adjusting the amount of heat energy transferred by the radiant energy heater into the road surface, with a faster speed requiring a greater amount of heat energy transferred by the radiant energy heater into the road surface and a slower speed requiring a lesser amount of heat energy transferred by the radiant energy heater into the road surface.

11. The apparatus of claim 10 wherein the motion sensor is a GPS-enabled device.

12. The apparatus of claim 10 wherein the control system incorporates a microprocessor which is for receiving information from the temperature sensor and from the motion sensor and for using that information to adjust the amount of power provided by the power generator to the radiant energy heater to raise or lower the amount of heat energy transferred by the radiant energy heater into the road surface.

13. The apparatus of claim 1, further comprising:

a hydraulic system for raising and lowering the air knife.

14. The apparatus of claim 1, further comprising a vehicle for traveling across the road surface, wherein the air knife is mounted on a front end of the vehicle and the radiant energy heater is mounted on the vehicle behind the air knife.

15. The apparatus of claim 1, wherein the radiant energy heater includes a plurality of radiant energy heaters.

16. The apparatus of claim 15, wherein each of the radiant energy heaters is individually height adjustable.

17. The apparatus of claim 14, wherein the air knife is adjustable in width so as to selectively extend beyond a first and a second side of the vehicle.

18. The apparatus of claim 1, wherein the radiant energy heater is one of the group of: infrared heater, medium wavelength infrared heater, and microwave heater.

19. Apparatus for drying a road surface which has a liquid thereon, the apparatus comprising:

an air knife, a compressor, a radiant energy heater, a control system, a motion sensor, and a power generator;

wherein the air knife is for providing a stream of unheated gas sufficiently forceful to push the liquid from the road surface;

the compressor is for supplying the unheated gas to the air knife;

the radiant energy heater is for transferring a sufficient amount of heat energy into the road surface to cause a sufficient temperature increase of the road surface to result in the evaporation of any residual liquid remaining on the road surface after the unheated gas is applied to the liquid on the road surface, wherein the radiant energy heater does not come into direct contact with the road surface and only minimal radiant heat energy is transferred to subsurface regions of the road;

the power generator is for providing power to the radiant energy heater so that the radiant energy heater can produce heat energy;

the motion sensor is suitably configured to determine the apparatus' speed relative to the road surface, and the control system is suitably configured to automatically adjust the amount of heat energy transferred by the radiant energy heater into the road surface based on the speed of the apparatus as determined by the motion sensor, with a faster speed requiring a greater amount of heat energy transferred by the radiant energy heater into the road surface and a slower speed requiring a lesser amount of heat energy transferred by the radiant energy heater into the road surface.

20. The apparatus of claim 19 further comprising a control mechanism, wherein the control mechanism is for controlling the distance of the radiant energy heater from the road surface.

21. The apparatus of claim 20 wherein the control mechanism comprises a hydraulic system for raising and lowering the radiant energy heater.

22. The apparatus of claim 19 wherein the control system is for adjusting the amount of power provided by the power generator to the radiant energy heater to raise or lower the amount of heat energy transferred by the radiant energy heater into the road surface.

23. The apparatus of claim 22 wherein the control system incorporates a microprocessor which is for receiving information from the motion sensor and for using that information to adjust the amount of power provided by the power generator to the radiant energy heater.

24. The apparatus of claim 19 wherein the radiant energy heater includes a plurality of radiant energy heaters, wherein the control system is for adjusting the amount of heat energy transferred by the radiant energy heaters into the road surface by cycling one or more radiant energy heaters on and off.

25. The apparatus of claim 24 wherein at least one of the plurality of radiant energy heaters is positioned a different distance from the road surface than at least one other radiant energy heater.

26. The apparatus of claim 19 wherein the motion sensor is a GPS-enabled device.

27. The apparatus of claim 19, further comprising:

a hydraulic system for raising and lowering the air knife.

28. The apparatus of claim 19, further comprising a vehicle for traveling across the road surface, wherein the air knife is mounted on a front end of the vehicle and the radiant energy heater is mounted on the vehicle behind the air knife.

29. The apparatus of claim 19, wherein the radiant energy heater includes a plurality of radiant energy heaters.

30. The apparatus of claim 29, wherein each of the radiant energy heaters is individually height adjustable.

31. The apparatus of claim 28, wherein the air knife is adjustable in width so as to selectively extend beyond a first and a second side of the vehicle.

32. The apparatus of claim 19, wherein the radiant energy heater is one of the group of: infrared heater, medium wavelength infrared heater, and microwave heater.

* * * * *